US011078756B2

(12) United States Patent
Maddux et al.

(10) Patent No.: US 11,078,756 B2
(45) Date of Patent: Aug. 3, 2021

(54) METHOD AND APPARATUS FOR INTRODUCING A JUNCTION ASSEMBLY INCLUDING A TRANSITION JOINT AND A LOAD TRANSFER DEVICE

(71) Applicant: Halliburton Energy Services, Inc., Houston, TX (US)

(72) Inventors: Stephen Ross Maddux, Carrollton, TX (US); Shane Patrick Furlong, Frisco, TX (US); David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 19 days.

(21) Appl. No.: 16/478,443

(22) PCT Filed: Jul. 25, 2018

(86) PCT No.: PCT/US2018/043751

§ 371 (c)(1),
(2) Date: Jul. 16, 2019

(87) PCT Pub. No.: WO2020/023035

PCT Pub. Date: Jan. 30, 2020

(65) Prior Publication Data

US 2020/0378203 A1 Dec. 3, 2020

(51) Int. Cl.

| | |
|---|---|
| ***E21B 41/00*** | (2006.01) |
| ***E21B 23/01*** | (2006.01) |
| ***E21B 29/06*** | (2006.01) |

(52) U.S. Cl.

CPC ..... *E21B 41/0035* (2013.01); *E21B 23/01* (2013.01); *E21B 41/0042* (2013.01); *E21B 29/06* (2013.01)

(58) Field of Classification Search

CPC .. E21B 41/0035; E21B 41/0042; E21B 23/01; E21B 29/06

See application file for complete search history.

(56) References Cited

U.S. PATENT DOCUMENTS

| | | | |
|---|---|---|---|
| 5,477,925 | A | 12/1995 | Trahan et al. |
| 5,845,707 | A | 12/1998 | Longbottom |
| 6,244,340 | B1 | 6/2001 | McGlothen et al. |
| 6,315,054 | B1 | 11/2001 | Brunet |

(Continued)

FOREIGN PATENT DOCUMENTS

| | | | |
|---|---|---|---|
| EP | 1508666 | B1 | 10/2011 |
| WO | 2017099780 | A1 | 6/2017 |

OTHER PUBLICATIONS

International Search Report and Written Opinion dated Apr. 19, 2019; International PCT Application No. PCT/US2018/043751.

*Primary Examiner* — Giovanna Wright
*Assistant Examiner* — Jonathan Malikasim
(74) *Attorney, Agent, or Firm* — McGuireWoods LLP

(57) ABSTRACT

A junction system to line a lateral wellbore can include a junction assembly and a running tool. The junction assembly can include an anchor, a transition joint, a load transfer device, and a lateral liner. The running tool assembly can be configured to extend within a central bore of the junction assembly. The running tool assembly can include a setting tool to set the anchor and a locking device to permit transfer of axial or rotational force between the lateral liner and a work string.

20 Claims, 9 Drawing Sheets

(56) References Cited

U.S. PATENT DOCUMENTS

| | | | | |
|---|---|---|---|---|
| 6,848,504 | B2 | 2/2005 | Brunet | |
| 7,104,332 | B2 | 9/2006 | Murray et al. | |
| 7,231,980 | B2 | 6/2007 | Murray et al. | |
| 8,069,920 | B2 | 12/2011 | Cronley et al. | |
| 9,644,459 | B2 | 5/2017 | Themig | |
| 2003/0221843 | A1 | 12/2003 | Fipke et al. | |
| 2010/0071905 | A1 | 3/2010 | Renshaw et al. | |
| 2013/0126165 | A1 | 5/2013 | Themig | |
| 2014/0190688 | A1 | 7/2014 | Cronley et al. | |
| 2015/0047853 | A1 | 2/2015 | Hurtado | |
| 2016/0145956 | A1 | 5/2016 | Dahl et al. | |
| 2017/0218726 | A1 | 8/2017 | Themig | |
| 2018/0045020 | A1 | 2/2018 | Steele et al. | |
| 2018/0320487 | A1* | 11/2018 | Themig | E21B 43/08 |

* cited by examiner

METHOD AND APPARATUS FOR INTRODUCING A JUNCTION ASSEMBLY INCLUDING A TRANSITION JOINT AND A LOAD TRANSFER DEVICE

TECHNICAL FIELD

The present description relates in general to junction assemblies, and more particularly, for example and without limitation, to methods and apparatuses for introducing a junction assembly with a lateral liner in a single trip.

BACKGROUND OF THE DISCLOSURE

In the oil and gas industry, hydrocarbons are produced from wellbores traversing subterranean hydrocarbon producing formations. Many current well completions include more than one wellbore. For example, a first, generally vertical wellbore may be initially drilled within or adjacent to one or more hydrocarbon producing formations. Any number of additional wellbores may then be drilled extending generally laterally away from the first wellbore to respective locations selected to optimize production from the associated hydrocarbon producing formation or formations. Such well completions are commonly referred to as multilateral wells.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to junction assemblies, and more particularly, for example and without limitation, to methods and apparatuses for introducing a junction assembly with a lateral liner in a single trip.

After the formation of a lateral wellbore, the open hole of the lateral wellbore can be lined for future operations. A lateral liner can be introduced into the well system through the main wellbore and advanced into the lateral wellbore. Further, a transition joint is introduced downhole to provide a transition joint window to allow access to portions of the primary wellbore below the access window to the lateral wellbore.

Advancing the lateral liner through the lateral wellbore often requires significant axial and rotational force to be applied to the lateral liner, particularly if the lateral wellbore is highly deviated. However, the transition joint often has limited axial and torsional strength due to the material removed to form the transition joint window. Therefore, a transition joint run downhole with the lateral liner may not be able to withstand the forces required to reliably set the lateral liner to a desired depth. Therefore, the introduction and setting of both the lateral liner and the transition joint often requires multiple trips with running tools to separately introduce the lateral liner and the transition joint.

An aspect of at least some embodiments disclosed herein is the realization that by releasably coupling a running tool to an anchor above the transition joint and a load transfer device below the transition joint, a lateral liner and a transition joint can be reliably introduced and set in a single trip.

Figure 1:
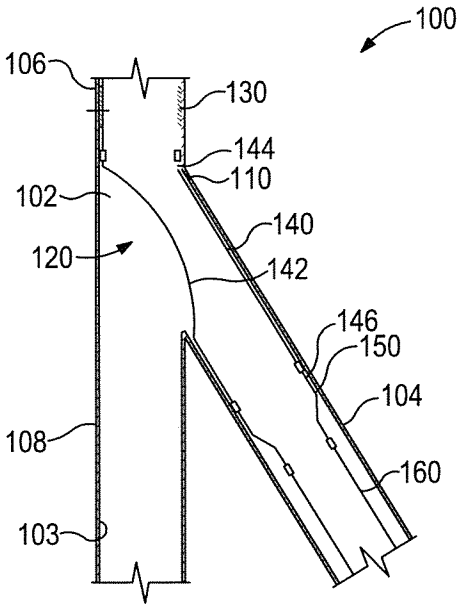
FIG. 1 is a cross-sectional view of a well system that can employ the principles of the present disclosure, according to some embodiments.

FIG. 1 is a cross-sectional view of a well system that can employ the principles of the present disclosure. As illustrated, the well system 100 may include a primary wellbore 102 and a secondary wellbore 104 that extends at an angle from the primary wellbore 102. The primary wellbore 102 can alternately be referred to as a parent wellbore or a main wellbore, and the secondary wellbore 104 can be referred to as a lateral wellbore. In some embodiments, the term "primary wellbore" may not imply that the wellbore is the first wellbore of a well, and the term "secondary wellbore" may not imply that the wellbore is the second wellbore of a well, but instead the terms "primary wellbore" and "secondary wellbore" may refer to the relationship between a parent wellbore and the lateral (or twig) wellbore that extends from the parent wellbore. While only one secondary wellbore 104 is depicted in FIG. 1, it will be appreciated that the well system 100 may include multiple secondary (lateral) wellbores 104 extending from the primary wellbore 102 at various locations. Likewise, it will be appreciated that the well system 100 may include multiple tertiary (twig) wellbores (not shown) extending from one or more of the secondary wellbores 104 at various locations. Accordingly, the well system 100 may be characterized and otherwise referred to as a "multilateral" wellbore system.

The primary and secondary wellbores 102, 104, may be drilled and completed using conventional well drilling techniques. The primary wellbore 102 can have a liner or casing 106.

A casing exit or window 110 may be milled, drilled, or otherwise defined along the casing 106 at the junction between the primary and secondary wellbores 102, 104. The casing window 110 generally provides access for downhole tools to enter the secondary wellbore 104 from the primary wellbore 102. The casing 106 above the casing window 110 can be referred to as upper wellbore casing 106 and the casing below the casing window 110 can be referred to as lower wellbore casing 108. Further, the portion of the wellbore 102 below the casing window 110 can be referred to as the lower wellbore 103.

Similarly, the open hole of the lateral wellbore 104 can be lined with a lateral liner 160. The lateral liner 160 can facilitate access to the lateral wellbore 104 and maintain the integrity of the lateral wellbore 104. In some embodiments, the lateral liner 160 is cemented into the lateral wellbore 104.

A junction assembly 120 can be interposed between the primary wellbore 102 and the secondary wellbore 104 to allow access to both wellbores 102, 104. In some embodiments, the junction assembly 120 can be interposed between any two wellbores, such as the secondary wellbore 104 and a tertiary (twig) wellbore (not shown). A transition joint 140 of the junction assembly 120 can provide access from the upper portion of the primary wellbore 102 to the secondary wellbore 104 and/or the lower wellbore 103. Further, the transition joint 140 can permit the transfer of fluids, including cement, frac fluids, acid treatments, etc., to the secondary wellbore 104 and/or the lower wellbore 103. In some embodiments, the transition joint 140 can provide access and/or permit transfer of fluids while a running tool is in place and/or after the running tool has been removed. In the depicted example, an upper end portion 144 of the transition joint 140 is disposed within the primary wellbore 102 while the lower end portion 146 of the transition joint 140 is disposed within the secondary wellbore 104, providing access to the secondary wellbore 104. Further, a transition joint window 142 formed in the transition joint 140 provides access to the lower wellbore 103. An anchor 130 can attach or anchor the transition joint 140 to the casing 106 within the primary wellbore 102.

As illustrated, a load transfer device 150 can couple the lateral liner 160 to the lower end portion 146 of the transition joint 140. The load transfer device 150 can be any suitable device or mechanism that allows loads, such as torque and/or axial loads to be transferred from the running tool to or from the lateral liner 160 or a work string. As described herein, by coupling the lateral liner 160 and the transition joint 140, the junction assembly 120 can advantageously be introduced and set within the well system 100 in a single trip, while reliably advancing the lateral liner 160 and the transition joint 140. The load transfer device 150 can be integrated with the lateral liner 160 or the transition joint 140.

Figure 2:
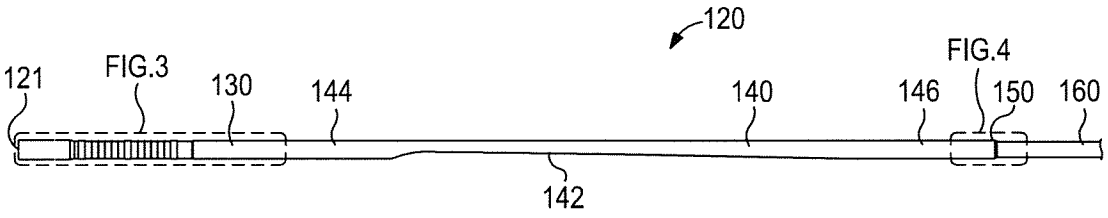
FIG. 2 is an elevation view of a junction assembly, according to some embodiments.

FIG. 2 is an elevation view of a junction assembly, according to some embodiments of the present disclosure. The junction assembly 120 includes an anchor 130, a transition joint 140, a load transfer device 150, and a lateral liner 160 coupled and having a collective central bore 121 therethrough. The coupling of the elements of the junction assembly 120 permits the introduction of the junction assembly 120, including the transition joint 140 and the lateral liner 160, into a well system together in a single trip.

In the depicted example, the transition joint 140 provides access between the upper portion of the primary wellbore and the secondary wellbore via the center bore 121. Further, the transition joint 140 includes a transition joint window 142 to allow additional path of access to the center bore 121. Therefore, during operation, the transition joint window 142 can provide access between the upper portion of the primary wellbore and the lower portion of the primary wellbore.

Removing or milling material of the transition joint 140 can form the transition joint window 142. For example, removing a partial cross section of the transition joint 140, such as an arc along the cross-sectional shape of the transition joint 140 can form the transition joint window 142. The transition joint window 142 can be a cut, groove, slot, or hole formed between the upper end portion 144 and the lower end portion 146. Optionally, the transition joint 140 can be introduced downhole without a window wherein the transition joint window 142 can be milled or cut at a downhole location.

In some embodiments, removal of material from the transition joint 140 to form the transition joint window 142 can reduce the axial and torsional strength and/or stiffness of the transition joint 140. Therefore, in some applications, the transition joint 140 may not be able to withstand or transmit axial or rotational forces therethrough.

As shown, an anchor 130 is coupled to the transition joint 140 at the upper end portion 144. The anchor 130 can couple or attach the transition joint 140 to casing to anchor the transition joint 140 within a primary wellbore.

Further, a load transfer device 150 is coupled to the transition joint 140 at the lower end portion 146. The load transfer device 150 can couple or attach the lateral liner 160 to the transition joint 140.

Figure 3:
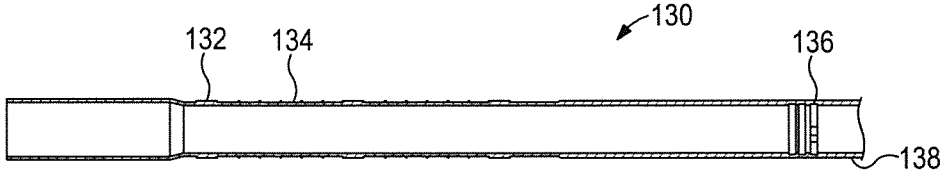
FIG. 3 is a cross-sectional view of an anchor of the junction assembly of FIG. 2, according to some embodiments.

FIG. 3 is a cross-sectional view of an anchor of the junction assembly of FIG. 2, according to some embodiments of the present disclosure. The anchor 130 can be coupled to the transition joint at the lower portion 138 of the anchor 130. The anchor 130 can be expandable or otherwise settable to anchor the transition joint to the casing. As illustrated, the anchor 130 includes an expandable portion 134 that can deform and expand. Optionally, the expandable portion 134 can include sealing portions 132 to seal or isolate the transition joint.

To facilitate expansion or setting with a setting tool, the anchor 130 can include an anchor profile 136 to interface with a setting tool. The anchor profile 136 is one or more geometric features that can engage with a setting tool to transmit axial forces experienced by the anchor 130 during setting. During operation, the anchor profile 136 can allow the anchor 130 to remain stationary during setting. Optionally, the anchor profile 136 may not transmit any rotational forces therethrough.

Figure 4:
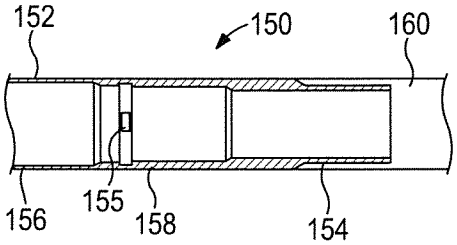
FIG. 4 is a cross-sectional view of a load transfer device of the junction assembly of FIG. 2, according to some embodiments.

FIG. 4 is a cross-sectional view of a load transfer device of the junction assembly of FIG. 2, according to some embodiments of the present disclosure. In the depicted example, the upper end 152 of the load transfer device 150 is coupled to the transition joint and the lower end 154 of the load transfer device 150 is coupled to the lateral liner 160. Therefore, the load transfer device 150 couples the lateral liner 160 to the transition joint 140.

Further, the load transfer device 150 includes a load transfer device profile 155. The load transfer device profile 155 includes one or more geometric features that can engage with a locking device. As illustrated, the load transfer device profile 155 includes axial force transfer surfaces 156 and rotational force transfer surfaces 158. Axial force transfer surfaces 156 can include surfaces with planes that are normal to axial movement of the load transfer device 150. Axial force transfer surfaces 156 can engage with the locking device to transfer axial force between the locking device and the load transfer device 150. Similarly, rotational force transfer surfaces 158 can include surfaces with planes that are normal to rotational movement of the load transfer device 150. Rotational force transfer surfaces 158 can engage with the locking device to transfer rotational force between the locking device and the load transfer device 150.

Optionally, as shown in the depicted example, the lateral liner 160 is rotationally and/or axially coupled to load transfer device 150. Therefore, the load transfer device profile 155 can transfer rotational and axial forces between the locking device and the lateral liner 160. By transferring loads between the lateral liner 160, the load transfer device 150, and the locking device coupled thereto, loads and forces required for advancing the lateral liner 160 can be diverted away from the transition joint. During operation, all of the force between the locking device and the lateral liner 160 can be diverted away from the transition joint. Optionally, some of the force between the lateral liner 160 and the locking device is diverted away from the transition joint.

Figure 5:
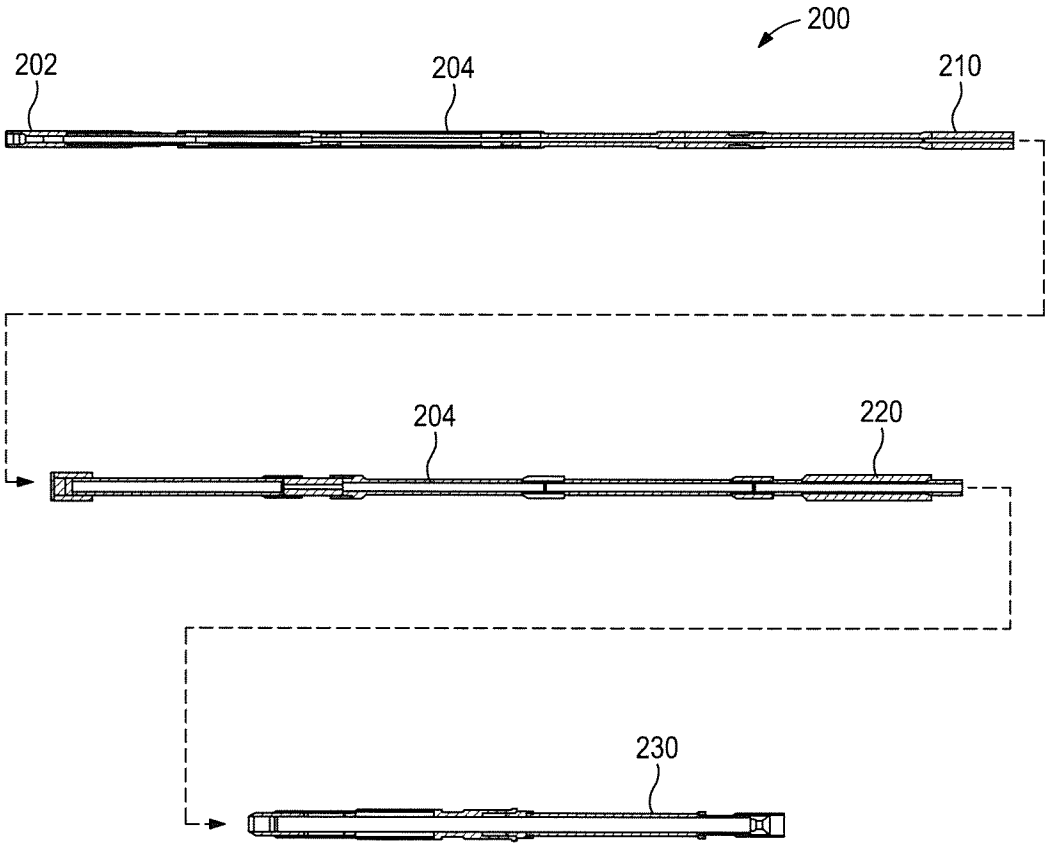
FIG. 5 is a cross-sectional view of a running tool, according to some embodiments.

FIG. 5 is a cross-sectional view of a running tool, according to some embodiments of the present disclosure. As illustrated, the running tool 200 includes an upper connection 202 configured to be attached to a drill string or work string. The work string can impart a rotational and/or axial force to the upper connection 202 and to the running tool 200 generally to advance and/or rotate the running tool 200.

In the depicted example, the running tool 200 is configured to be introduced into the central bore of the junction assembly. The running tool 200 can couple to the junction assembly at the setting tool 210 and the locking device 230 to advance, rotate, and set the junction assembly. Advantageously, by coupling the running tool above and below the transition joint, rotational and/or axial forces required for setting the lateral liner can be isolated from the transition joint.

During operation, the setting tool 210 is configured to engage the anchor within the central bore therein. The setting tool 210 can releasably couple to the anchor to set the anchor at the desired downhole location.

As illustrated, the locking device 230 is configured to engage the load transfer device profile within the inner surface of the load transfer device. The locking device 230 can releasably couple to the load transfer device to transfer axial and rotational force from the work string to the lateral liner for manipulation of the lateral liner during advancement of the lateral liner.

As illustrated, one or more extension mandrels 204 can be utilized to allow the setting tool 210 and the locking device 230 to be aligned with the anchor and the load transfer device of the junction assembly. As shown, extension mandrels 204 can extend across the axial distance of the transition joint to permit engagement of the setting tool 210 and the locking device 230 above and below the transition joint.

In some embodiments, the running tool 200 can include one or more actuating lugs 220 to rotationally and/or axially align the transition joint window with the window in the primary wellbore. During operation, the actuating lug 220 can extend to locate the bottom of the window. The actuating lug 220 can remain retracted during advancement of the running tool 200 to prevent damage to the casing or impediment to downhole travel.

Figure 6:
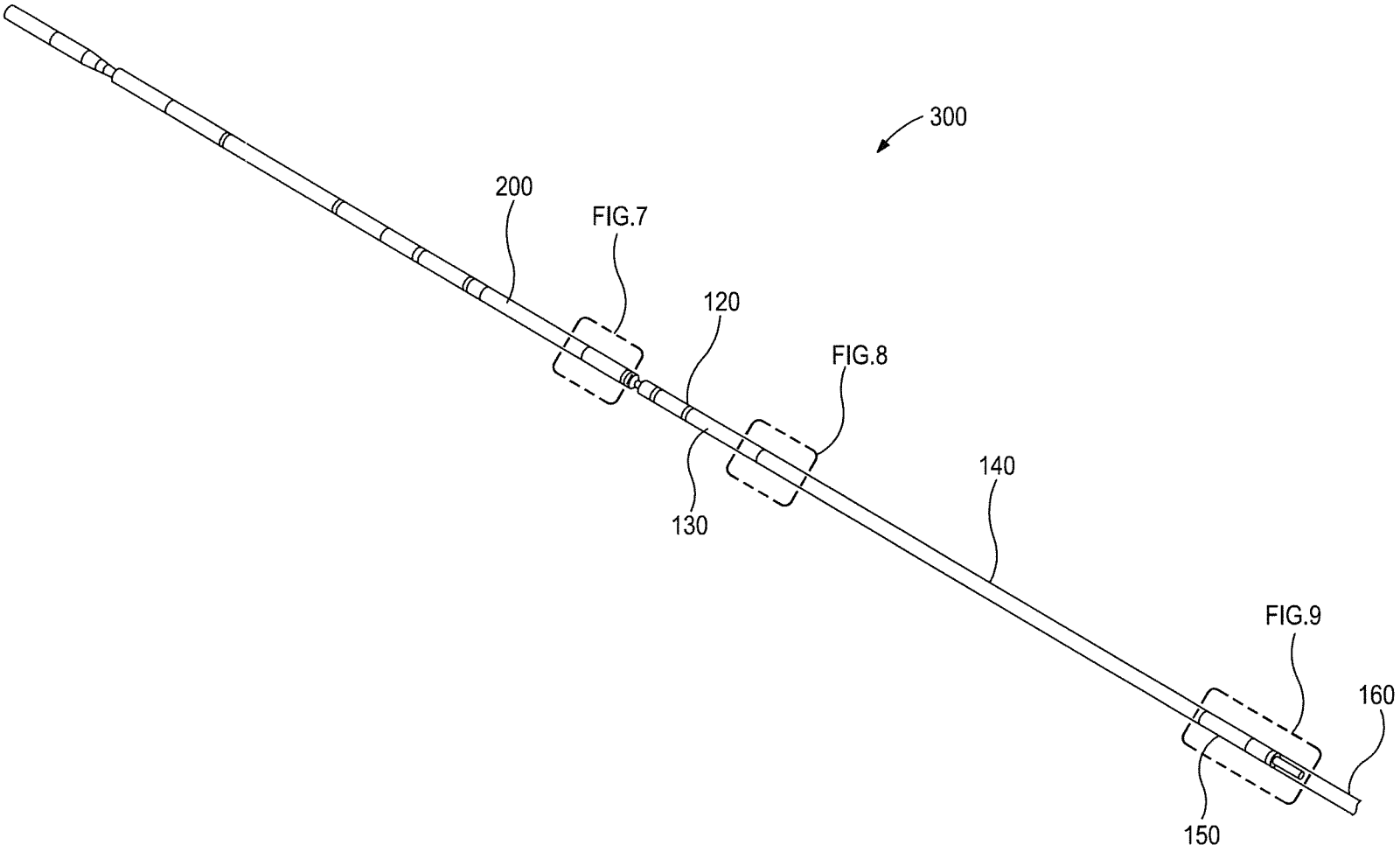
FIG. 6 is a perspective view of a junction system, according to some embodiments.

FIG. 6 is a perspective view of a junction system, according to some embodiments of the present disclosure. As shown, the junction assembly 120 receives the running tool 200, wherein the running tool 200 and the junction assembly 120 are collectively referred to as the junction system 300. In the depicted example, the running tool 200 is coupled to the junction assembly 120, to allow the junction assembly 120 to be advanced within the wellbore. As previously described, the running tool 200 is coupled to the junction assembly 120 at the anchor 130 and the load transfer device 150.

Further, the junction system 300 allows for setting of the anchor 130 and for imparting axial and/or rotational force to the lateral liner 160. In particular, as the load transfer device 150 couples the lateral liner 160 to the running tool 200, axial and/or rotational forces are diverted from the transition joint 140. By permitting a coupling of the running tool 200 to the lateral liner 160 via the load transfer device 150, the junction system 300 can provide sufficient transfer of force to allow the lateral liner 160 to reliably achieve a desired set depth and prevent damage to the transition joint.

Figure 7:
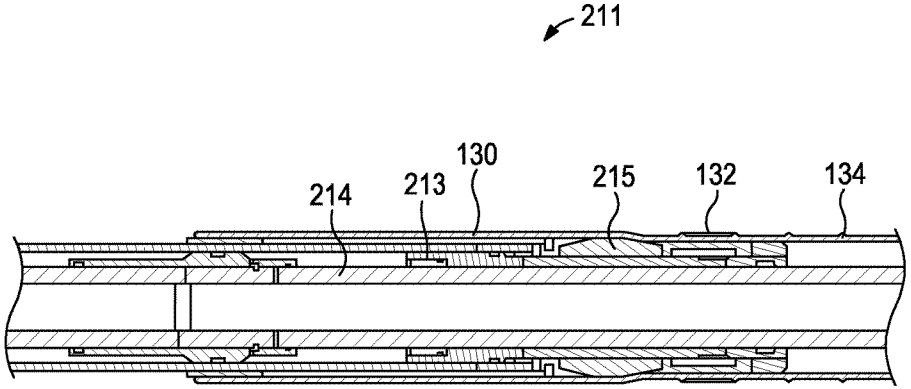
FIG. 7 is a cross-sectional view of an upper portion of a setting tool and an anchor of the junction system of FIG. 6, according to some embodiments.

FIG. 7 is a cross-sectional view of an upper portion 211 of the setting tool 210 and an anchor of the junction system of FIG. 6, according to some embodiments of the present disclosure. As shown, the upper portion 211 of the setting tool 210 is disposed within the anchor 130. In some embodiments, the upper portion 211 of the setting tool 210 expands the anchor 130 to anchor the junction assembly within the casing at a desired location.

Optionally, one or more expansion cones 215 are driven to expand against the expandable portion 134 of the anchor 130. During operation, the expansion cones 215 expand the expandable portion 134 and the sealing portions 132 against the casing to anchor the anchor. As shown, an actuator 213, such as a hydraulic piston, or an electro-mechanical actuator compresses, squeezes, or otherwise drives the one or more expansion cones 215 outward towards the expandable portion 134 of the anchor 130.

In some embodiments, slips configured to engage the casing, or other anchoring devices such as a conventional anchor can anchor the junction assembly.

Figure 8:
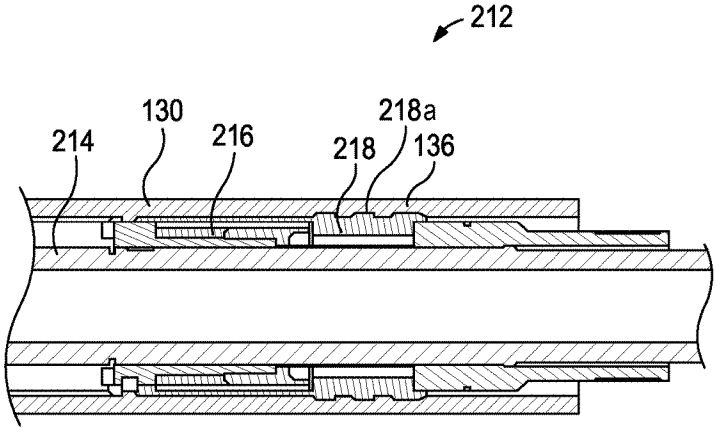
FIG. 8 is a cross-sectional view of a lower portion of the setting tool and the anchor of the junction system of FIG. 6, according to some embodiments.

FIG. 8 is a cross-sectional view of a lower portion 212 of the setting tool 210 and the anchor of the junction system of FIG. 6, according to some embodiments of the present disclosure. As shown, the lower portion 212 of the setting tool 210 is disposed within the anchor 130. During setting of the anchor 130, the anchor 130 may experience an axial reaction force. Therefore, the lower portion 212 of the setting tool 210 can engage with the anchor 130 to axially retain the anchor 130 during setting thereof.

As illustrated, one or more collets 218 have geometric features or a setting profile **218*a* complimentary to the profile of the anchor profile 136. Upon passing the anchor profile 136, the collets 218 can move along the mandrel 214 to engage the anchor profile 136. During operation, an actuation device 216 can move the collets 218 to an engaged position. The actuation devices 216 can similarly release the collets 218** as desired.

Upon engagement, the collets 218 have geometric features to axially retain the setting tool 212 relative to the anchor 130 to allow for setting of the anchor 130 without axial movement thereof. In some embodiments, the collets 218 do not rotationally constrain the setting tool 212 relative to the anchor 130, allowing for rotation therebetween.

Figure 9:
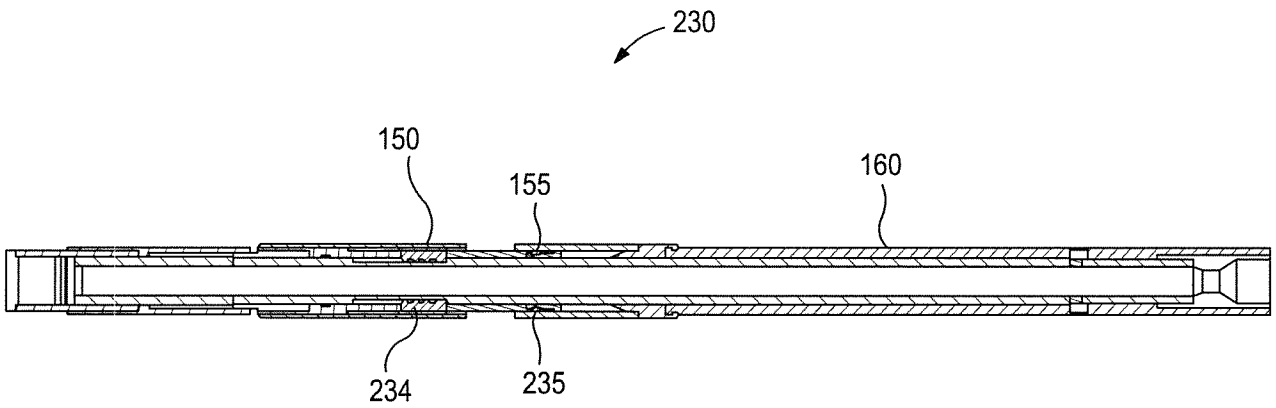
FIG. 9 is a cross-sectional view of a locking device and a load transfer device of the junction system of FIG. 6, according to some embodiments.

FIG. 9 is a cross-sectional view of a locking device and a load transfer device of the junction system of FIG. 6, according to some embodiments of the present disclosure.

As shown, the locking device 230 is disposed within the load transfer device 150. In the depicted example, the locking device 230 axially and/or rotationally couples with the load transfer device 150 below the transition joint to facilitate transfer of axial and/or rotational loads between the running tool and the lateral liner 160. Advantageously, by facilitating transfer therebetween, the running tool can impart high compression and torque loads to the lateral liner 160 to facilitate advancing the lateral liner 160 reliably into lateral wellbores, including highly deviated wellbores. In comparison, a setting tool and anchor coupling and/or a transition joint may not be able to transfer desired compression and torque loads to the lateral liner, necessitating multiple trips to install the lateral liner and the transition joint.

As shown, the locking device 230 utilizes a breach lock mechanism to axially and rotationally couple the locking device 230 to the load transfer device 150. As illustrated, the locking device 230 includes a complimentary locking profile 235 that includes one or more geometric features that is complimentary to or interfaces with the load transfer device profile 155. In some embodiments, the complimentary locking profile 235 includes a complimentary axial force transfer surface to engage against axial force transfer surfaces of the load transfer device profile 155 to engage and transfer axial force between the locking device 230 and the load transfer device 150. Similarly, the complimentary locking profile 235 includes a complimentary rotational force transfer surface to engage against rotational force transfer surfaces of the load transfer device profile 155 to engage and transfer rotational forces between the locking device 230 and the load transfer device 150.

In some embodiments, the locking device 230 utilizes frictional engagement between the complimentary locking profile 235 and the load transfer device profile 155 instead of or in addition to the geometric relationships of the profiles to facilitate transfer of force therebetween. Optionally, the complimentary locking profile 235 can be rotated, translated, and/or extended to engage the load transfer device profile 155 by an actuating mechanism 234. The actuating mechanism 234 can be hydraulic and/or electromechanical and can selectively engage and disengage the complimentary locking profile 235 from the load transfer device profile 155.

Further, the locking device 230 can utilize other engagement mechanisms such as a clutch in frictional engagement with an engagement surface.

Figure 10:
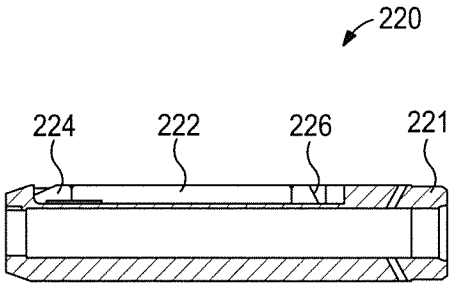
FIG. 10 is a cross-sectional view of an actuating lug in a retracted position, according to some embodiments.

FIG. 10 is a cross-sectional view of an actuating lug in a retracted position, according to some embodiments of the present disclosure. In the depicted example, the actuating lug 220 can be utilized to locate the bottom of the casing window in the primary wellbore and further axially and/or rotationally align the transition joint window with the casing window. Advantageously, by locating the bottom of the casing window, the actuating lug 220 can determine when the lateral liner is advanced to a desired depth to allow application of a set down force to set the lateral liner.

Embodiments of the actuating lug 220 can be described in U.S. Pat. No. 6,244,340. The actuating lug 220 can be installed in line with the extension mandrels to be aligned with the transition joint window. As illustrated, the actuating lug 220 is held in a retracted position to allow for introduction of the junction system without damage to or interference with the primary wellbore casing. A release mechanism 226 can hold the lug member 222 in a retracted position.

Figure 11:
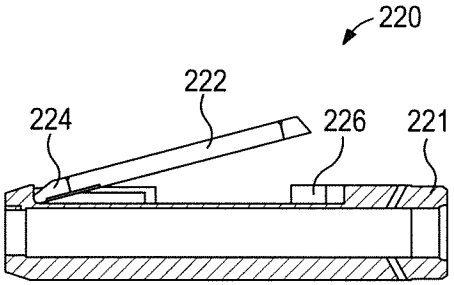
FIG. 11 is a cross-sectional view of the actuating lug of FIG. 10 in an actuated position, according to some embodiments.

FIG. 11 is a cross-sectional view of an actuating lug in an actuated position, according to some embodiments of the present disclosure. As illustrated, the lug member 222 of the actuating lug 220 is shown in an extended position. The lug member 222 can be deployed to be extended as the junction system approaches the casing window of the primary wellbore.

As shown, the lug member 222 is biased outward. As the release mechanism 226 releases the lug member 222, the lug member 222 can rotate away from the mandrel 221 to extend outward. The lug member 222 can rotate about a pivot 224.

The released lug member 222 can engage with a bottom of the casing window to axially and rotationally align the transition joint window with the casing window. Optionally, more than one actuating lug 220 can be utilized.

Figure 12:
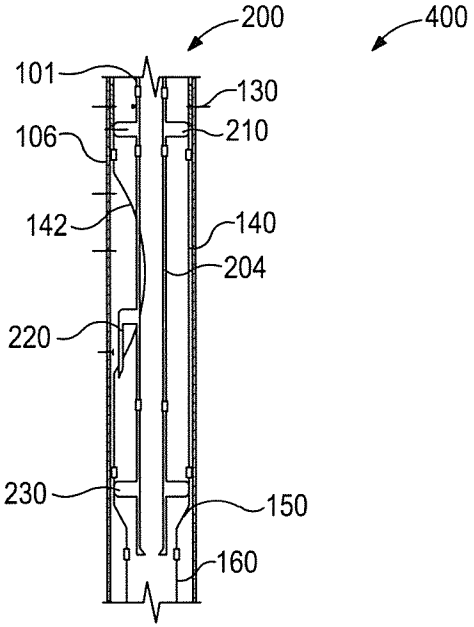
FIG. 12 is a cross-sectional view of a junction system introduced into a primary wellbore, according to some embodiments.

FIG. 12 is a cross-sectional view of a junction system introduced into a primary wellbore, according to some embodiments of the present disclosure. In the depicted example, the junction system 400 is shown being introduced and advanced into the primary wellbore 102. The running tool 200 can advance the junction system 400.

At an upper end, the running tool 200 is coupled to a work string 101 to axially and rotationally urge the junction system 400 within the primary wellbore 102. During operation, the running tool 200 advances the anchor 130, the transition joint 140, the load transfer device 150, and the lateral liner 160 together in a single trip. As previously described, the running tool 200 is coupled to the anchor 130 via the setting tool 210 and to the load transfer device 150 via the locking device 230. Further, the actuating lug 220 is aligned with a lower portion of the transition joint window 142. As the junction system 400, and in particular the transition joint 140, is disposed above a casing window, the actuating lug 220 remains retracted to allow for travel of the junction system 400 through the primary wellbore 102.

Figure 13:
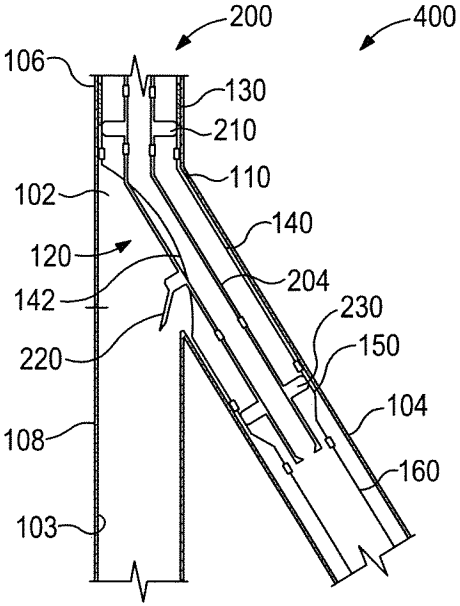
FIG. 13 is a cross-sectional view of the junction system advancing into a lateral wellbore, according to some embodiments.

FIG. 13 is a cross-sectional view of the junction system advancing into a lateral wellbore, according to some embodiments of the present disclosure. As illustrated, portions of the junction system 400 can be introduced into the lateral wellbore 104. In particular, as illustrated, the lateral liner 160 and portions of the transition joint 140 can deviate and advance through the lateral wellbore 104.

During advancement of the lateral liner 160 through the lateral wellbore 104, the locking device 230 and the load transfer device 150 apply rotational and/or axial force to the lateral liner 160. In some applications, highly deviated wellbore paths can require significant axial and/or radial force upon the lateral liner 160.

Advantageously, by providing sufficient force to the lateral liner 160 via the load transfer device 150 and the locking device 230, the lateral liner 160 can reliably be advanced to a desired depth. Optionally, the actuating lug 220 can extend through the transition joint window 142 to locate the lower portion of the casing window 110. The actuating lug 220 can catch or engage a portion of the casing window 110, for example the lower portion of the casing window 110, to locate and align the transition joint window 142 with the casing window 110.

Further, the position of the actuating lug 220 can confirm the location or depth of the lateral liner 160. After the lateral liner 160 is located to a desired depth, the running tool 200 can apply a set down weight to set the lateral liner 160 in position. In some embodiments, the lateral liner 160 is set by rotating the running tool 200. Optionally, the running tool 200 can direct cement around the lateral liner 160 to cement the lateral liner 160 in position.

After the lateral liner 160 is set to depth, the anchor 130 can be set to anchor the transition joint 140 to the casing 106. The setting tool 210 can set the anchor 130 as previously described. Advantageously, a single running tool 200 can introduce and set both the lateral liner 160 and the anchor 130 in a single trip.

Upon setting the anchor 130, the running tool 200 can disengage the load transfer device 150 and the anchor 130 and be retrieved from the well system.

Various examples of aspects of the disclosure are described below as clauses for convenience. These are provided as examples, and do not limit the subject technology.

Clause 1. A method to introduce a junction assembly from a primary wellbore into a lateral wellbore, the method comprising: introducing a running tool into the junction assembly, wherein the junction assembly includes an anchor, a transition joint coupled to the anchor, a load transfer device coupled to the transition joint, and a lateral liner coupled to the load transfer device; releaseably coupling the running tool to the anchor and to the load transfer device; advancing the running tool and the junction assembly through a casing of the primary wellbore; introducing the lateral liner through a casing window of the casing; and applying rotational or axial force to the lateral liner and the load transfer device via the running tool to position the lateral liner within the lateral wellbore.

Clause 2. The method of Clause 1, further comprising diverting a load from the lateral liner to the running tool via the load transfer device.

Clause 3. The method of Clause 1 or 2, further comprising locating the casing window via the running tool.

Clause 4. The method of any preceding clause, further comprising milling a transition joint window in the transition joint.

Clause 5. The method of Clause 4, wherein milling the transition joint window comprises milling the transition joint window at a downhole location.

Clause 6. The method of any preceding clause, further comprising aligning a transition joint window of the transition joint with the casing window.

Clause 7. The method of Clause 6, wherein aligning the transition joint window further comprises axially aligning the transition joint with the casing window.

Clause 8. The method of Clause 6, wherein aligning the transition joint window further comprises rotationally aligning the transition joint with the casing window.

Clause 9. The method of any preceding clause, further comprising cementing the lateral liner within the lateral wellbore.

Clause 10. The method of any preceding clause, further comprising setting the anchor.

Clause 11. The method of Clause 10, wherein setting the anchor further comprises expanding the anchor.

Clause 12. The method of Clause 11, wherein expanding the anchor comprises hydraulically expanding the anchor.

Clause 13. The method of Clause 11, wherein expanding the anchor comprises mechanically expanding the anchor.

Clause 14. The method of any preceding clause, further comprising: disengaging the running tool from the junction assembly; and retrieving the running tool from the primary wellbore.

Clause 15. A junction system to line a lateral wellbore extending from a primary wellbore, the junction system comprising: a junction assembly including an anchor, a transition joint, a load transfer device, and a lateral liner that collectively define a central bore extending therethrough, the transition joint coupled to the anchor, the transition joint including a transition joint window extending through the transition joint into the central bore, the load transfer device coupled to the transition joint, the load transfer device including a load transfer device profile disposed within the central bore, wherein the load transfer device profile includes an axial engagement portion and a rotational engagement portion, the lateral liner positioned below the transition joint; and a running tool assembly configured to extend within the central bore of the junction assembly, the running tool assembly including: an upper connection to a work string; connection; and a locking device axially spaced apart from the setting tool, the locking device including locking profile complimentary to the load transfer device profile to engage with the axial engagement portion or the rotational engagement portion of the load transfer device profile, wherein axial and rotational engagement between the load transfer device and the locking device permits transfer of axial or rotational force between the lateral liner and the work string.

Clause 16. The junction system of Clause 15, further comprising a mechanical actuator coupled to the expansion cone.

Clause 17. The junction system of Clause 15 or 16, further comprising a hydraulic piston coupled to the expansion cone.

Clause 18. The junction system of Clauses 15-17, further comprising an extension mandrel coupling the setting tool and the locking device.

Clause 19. The junction system of Clause 18, wherein the extension mandrel extends across the transition joint.

Clause 20. The junction system of Clauses 15-19, further comprising an actuating lug assembly disposed between the setting tool and the locking device, the actuating lug assembly including: a lug pivotably coupled to a lug body at a pivot; and a biasing member radially urging the lug away from the lug body.

Clause 21. The junction system of Clause 20, further comprising a retention mechanism releasably coupling the lug to the lug body, wherein the retention mechanism is disposed opposite to the pivot.

Clause 22. The junction system of Clause 20, wherein the actuating lug assembly includes a plurality of actuating lug assemblies.

Clause 23. A junction system to line a lateral wellbore extending from a primary wellbore, the junction system comprising: a junction assembly an anchor, a transition joint, a load transfer device, and a lateral liner that collectively define a central bore extending therethrough, the anchor including an anchor profile disposed within the central bore, the transition joint coupled to the anchor, the load transfer device coupled to the transition joint, the load transfer device including an inner engagement surface, the lateral liner coupled to the load transfer device; and a running tool assembly configured to extend within the central bore of the junction assembly, the running tool assembly including: an upper connection configured to be coupled to a work string; a setting tool coupled to the upper connection, the setting tool including a setting tool collet, and a mandrel extending within the setting tool collet, wherein the setting tool collet includes a setting profile complimentary to the anchor profile and is configured to receive the anchor profile; and a locking device axially spaced apart from the setting tool, the locking device including locking profile configured to engage the inner engagement surface, wherein axial and rotational engagement between the load transfer device and the locking device permits transfer of axial or rotational force between the lateral liner and the work string.

Clause 24. The junction system of Clause 23, wherein the anchor includes a slip assembly disposed on an outer surface of the anchor, wherein the slip assembly is coupled to the inner engagement surface.

Clause 25. The junction system of Clause 23 or 24, wherein the locking device includes a clutch configured to engage the inner engagement surface.

Clause 26. The junction system of Clauses 23-25, further comprising an extension mandrel coupling the setting tool and the locking device.

Clause 27. The junction system of Clause 26, wherein the extension mandrel extends across the transition joint.

Clause 28. The junction system of Clauses 23-27, further comprising an actuating lug assembly disposed between the setting tool and the locking device, the actuating lug assembly including: a lug pivotably coupled to a lug body at a pivot; and a biasing member radially urging the lug away from the lug body.

Clause 29. The junction system of Clause 28, further comprising a retention mechanism releasably coupling the lug to the lug body, wherein the retention mechanism is disposed opposite to the pivot.

Clause 30. The junction system of Clause 28, wherein the actuating lug assembly includes a plurality of actuating lug assemblies.

Clause 31. A junction system to line a lateral wellbore extending from a primary wellbore, the junction system comprising: an anchor including an expandable portion and an anchor profile disposed within a central bore of the anchor; a transition joint coupled to the anchor, the transition joint including a transition joint window extending through the transition joint; a load transfer device coupled to the transition joint, the load transfer device including a load transfer device profile disposed within the central bore, wherein the load transfer device profile includes an axial engagement portion and a rotational engagement portion; and a lateral liner coupled to the load transfer device.

Clause 32. A running tool assembly to line a lateral wellbore extending from a primary wellbore, the running tool assembly comprising: an upper connection configured to be coupled to a work string; a setting tool coupled to the upper connection, the setting tool including an expansion cone, a setting tool collet, and a mandrel extending within the expansion cone and the setting tool collet, wherein the setting tool collet includes a setting profile; and a locking device axially spaced apart from the setting tool, the locking device including locking profile, wherein the locking device permits transfer of axial or rotational force between the locking device and the work string.

Clause 33. The running tool assembly of Clause 32, further comprising a mechanical actuator coupled to the expansion cone.

Clause 34. The running tool assembly of Clause 32 or 33, further comprising a hydraulic piston coupled to the expansion cone.

Clause 35. The running tool assembly of Clauses 32-34, further comprising an extension mandrel coupling the setting tool and the locking device.

Clause 36. The running tool assembly of Clauses 32-35, further comprising an actuating lug assembly disposed between the setting tool and the locking device, the actuating lug assembly including: a lug pivotably coupled to a lug body at a pivot; and a biasing member radially urging the lug away from the lug body.

Clause 37. The running tool assembly of Clause 36, further comprising a retention mechanism releasably coupling the lug to the lug body, wherein the retention mechanism is disposed opposite to the pivot.

Clause 38. The running tool assembly of Clause 36, wherein the actuating lug assembly includes a plurality of actuating lug assemblies.

What is claimed is:

1. A method to introduce a junction assembly from a primary wellbore into a lateral wellbore, the method comprising:

introducing a running tool into the junction assembly, wherein the junction assembly includes an anchor, a transition joint coupled to the anchor, a load transfer device coupled to the transition joint, and a lateral liner coupled to the load transfer device;

milling a transition joint window in the transition joint;

releaseably coupling the running tool to the anchor and to the load transfer device;

advancing the running tool and the junction assembly through a casing of the primary wellbore;

introducing the lateral liner through a casing window of the casing; and applying rotational or axial force to the lateral liner and the load transfer device via the running tool to position the lateral liner within the lateral wellbore.

2. The method of claim 1, further comprising diverting a load from the lateral liner to the running tool via the load transfer device.

3. The method of claim 1, further comprising locating the casing window via the running tool.

4. The method of claim 1, wherein milling the transition joint window comprises milling the transition joint window at a downhole location.

5. The method of claim 1, further comprising aligning the transition joint window of the transition joint with the casing window.

6. The method of claim 5, wherein aligning the transition joint window further comprises axially aligning the transition joint with the casing window.

7. The method of claim 5, wherein aligning the transition joint window further comprises rotationally aligning the transition joint with the casing window.

8. The method of claim 1, further comprising cementing the lateral liner within the lateral wellbore.

9. The method of claim 1, further comprising setting the anchor.

10. The method of claim 9, wherein setting the anchor further comprises expanding the anchor.

11. The method of claim 10, wherein expanding the anchor comprises hydraulically expanding the anchor.

12. The method of claim 10, wherein expanding the anchor comprises mechanically expanding the anchor.

13. The method of claim 1, further comprising:

disengaging the running tool from the junction assembly; and retrieving the running tool from the primary wellbore.

14. A junction system to line a lateral wellbore extending from a primary wellbore, the junction system comprising:

a junction assembly including an anchor, a transition joint, a load transfer device, and a lateral liner that collectively define a central bore extending therethrough, the transition joint coupled to the anchor, the transition joint including a transition joint window extending through the transition joint into the central bore, the load transfer device coupled to the transition joint, the load transfer device including a load transfer device profile disposed within the central bore, wherein the load transfer device profile includes an axial engagement portion and a rotational engagement portion, the lateral liner positioned below the transition joint; and a running tool assembly configured to extend within the central bore of the junction assembly, the running tool assembly including:

an upper connection to a work string;

a setting tool coupled to the upper connection; and a locking device axially spaced apart from the setting tool, the locking device including locking profile complimentary to the load transfer device profile to engage with the axial engagement portion or the rotational engagement portion of the load transfer device profile, wherein axial and rotational engagement between the load transfer device and the locking device permits transfer of axial or rotational force between the lateral liner and the work string.

15. The junction system of claim 14, further comprising a mandrel coupling the setting tool and the locking device.

16. The junction system of claim 15, wherein the mandrel extends across the transition joint.

17. The junction system of claim 15, further comprising an actuating lug assembly disposed between the setting tool and the locking device, the actuating lug assembly including:

a lug having a lug member and a pivot, the lug coupled to a mandrel; and the lug member and the pivot configured to urge the lug away from the mandrel.

18. The junction system of claim 17, wherein the actuating lug assembly includes a plurality of actuating lug assemblies.

19. A junction system to line a lateral wellbore extending from a primary wellbore, the junction system comprising:

a junction assembly including an anchor, a transition joint, a load transfer device, and a lateral liner that collectively define a central bore extending therethrough, the anchor including an anchor profile disposed within the central bore, the transition joint coupled to the anchor, the load transfer device coupled to the transition joint, the load transfer device including an inner engagement surface, the lateral liner coupled to the load transfer device; and a running tool assembly configured to extend within the central bore of the junction assembly, the running tool assembly including:

an upper connection to a work string;

a setting tool coupled to the upper connection, the setting tool including a setting tool collet, and a mandrel extending within the setting tool collet, wherein the setting tool collet includes a setting profile complimentary to the anchor profile and is configured to receive the anchor profile; and a locking device axially spaced apart from the setting tool, the locking device including a locking profile configured to engage the inner engagement surface, wherein axial and rotational engagement between the load transfer device and the locking device permits transfer of axial or rotational force between the lateral liner and the work string.

20. The junction system of claim 19, wherein the mandrel extends across the transition joint.

* * * * *